US007450074B2

(12) United States Patent
Tung

(10) Patent No.: US 7,450,074 B2
(45) Date of Patent: Nov. 11, 2008

(54) MOBILE COMMUNICATION DEVICE

(75) Inventor: Hao-Chun Tung, Jinmen County (TW)

(73) Assignee: Qisda Corporation, Taoyuan County (TW)

( * ) Notice: Subject to any disclaimer, the term of this patent is extended or adjusted under 35 U.S.C. 154(b) by 440 days.

(21) Appl. No.: 11/362,947

(22) Filed: Feb. 28, 2006

(65) Prior Publication Data

US 2006/0197709 A1 Sep. 7, 2006

(30) Foreign Application Priority Data

Mar. 2, 2005 (TW) ..... 94106223 A

(51) Int. Cl.
*H01Q 1/24* (2006.01)

(52) U.S. Cl. ..... 343/702; 343/846

(58) Field of Classification Search ..... 343/702, 343/700 MS, 846, 848
See application file for complete search history.

(56) References Cited

U.S. PATENT DOCUMENTS 6,252,552 B1 * 6/2001 Tarvas et al. ..... 343/700 MS
2005/0184915 A1 * 8/2005 Nagel et al. ..... 343/702

* cited by examiner

*Primary Examiner*—HoangAnh T Le

(57) ABSTRACT

A mobile communication device. An antenna provides an output signal including a first resonance frequency and a wavelength. A printed circuit board (PCV) includes a metal grounding face and a layout face opposite the metal grounding face and is coupled to the antenna at a first node. A metal module is coupled to the metal grounding face at a second node. A distance between the first node and the second node is determined by the wavelength.

20 Claims, 8 Drawing Sheets

MOBILE COMMUNICATION DEVICE

BACKGROUND

The disclosure relates to a mobile communication device, and more particularly to a mobile communication device having a metal module.

Conventional mobile communication devices require small size and for optimum probability.

Many functions have been added to mobile communication devices, such as camera, recording, remote-control functions. While usability of the mobile communication device is increased by adding the functions, likelihood of damage to the mobile communication device is also increased.

For example, as a user has charges generated by rub and contacts a mobile communication device, a discharge phenomenon, called an electrostatic discharge (ESD) event, may cause on the mobile communication device.

Electrical elements of conventional mobile communication device only sustain milliampere current. When an ESD event occurs, large discharge current will be generated in a short time. If the ESD event occurs on the mobile communication device, the large current will damage electrical elements of the mobile communication device.

A conventional solution increases elements in the mobile communication device to avoid the damage, however the cost of the mobile communication device is increased and usable space for electrical elements of the mobile communication device reduced.

Additionally, since the mobile communication device is small and constantly in transport, impact damage is common. A conventional solution disposes a metal protector skirting the mobile communication device to increase rigidity. However, the metal protector interferes with the radiation of the mobile communication device, causing signal loss.

SUMMARY

Embodiments of the invention provide a mobile communication device comprising an antenna, a printed circuit board, and a metal module. The antenna transmits an output signal comprising a first resonance frequency and a wavelength. The printed circuit board (PCV) comprises a metal grounding face and a layout face opposite the metal grounding face and is coupled to the antenna at a first node. The metal module is coupled to the metal grounding face at a second node.

A distance between the first node and the second node is determined by the wavelength.

BRIEF DESCRIPTION OF THE DRAWINGS

The invention can be more fully understood by reading the subsequent detailed description and examples with reference made to the accompanying drawings, wherein.

DETAILED DESCRIPTION

Mobile communication devices, for example personal digital assistants (PDA) and mobile phones, can be found in the market. A clam type mobile phone is given as an example of the mobile communication device, although the disclosure is not limited thereto.

Figure 1:
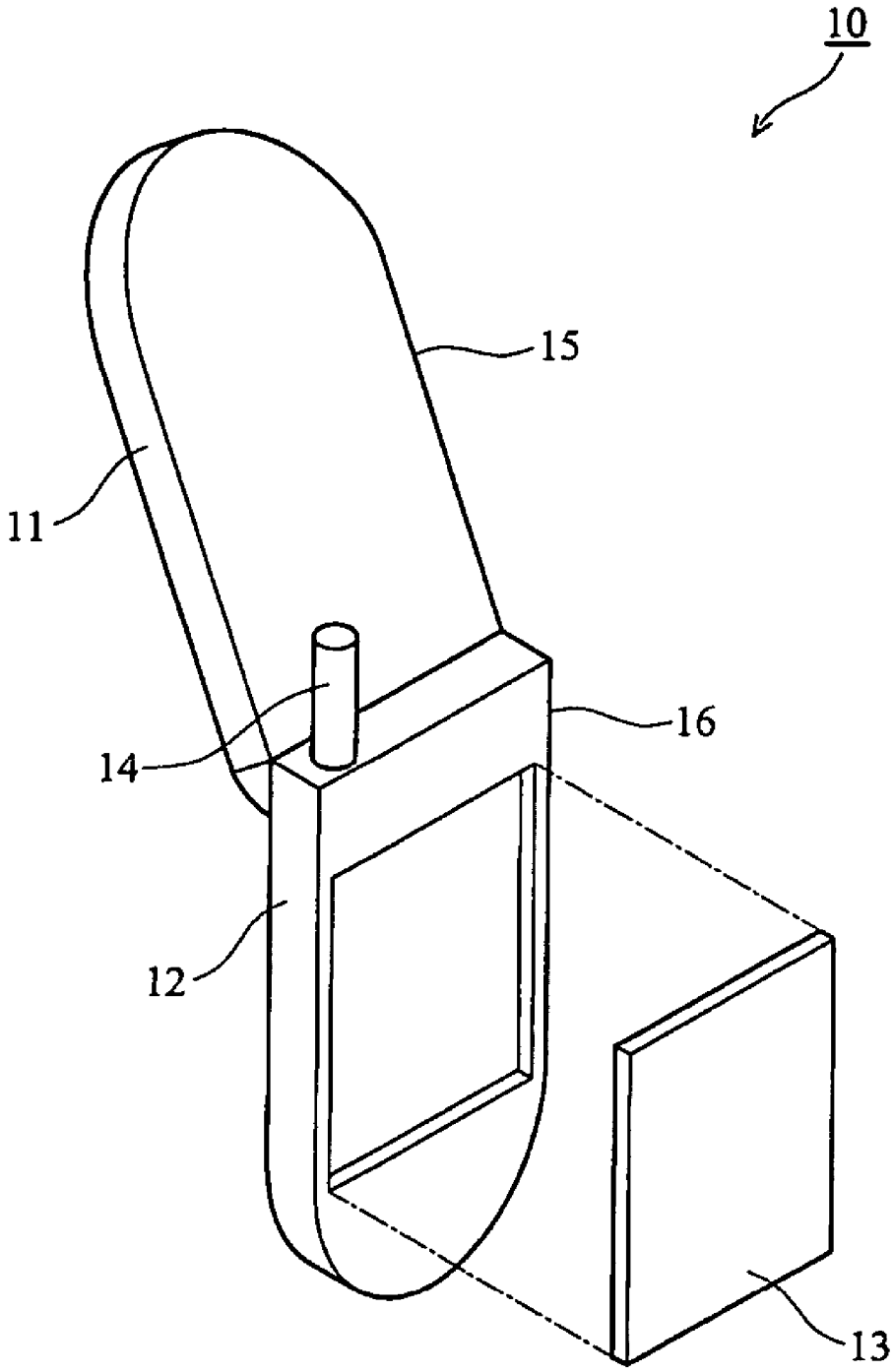
FIG. 1 is a schematic diagram of a conventional mobile phone.

FIG. 1 is a schematic diagram of a clam type mobile phone 10 comprising a first section 11, a second section 12, a battery 13, and an antenna 14. Label 15 indicates the casing of first section 11 and label 16 indicates the casing of second section 12.

Antenna 14 transmits an output signal comprising a resonance frequency f and a wavelength λ. A relation between the resonance frequency f and the wavelength λ is obtained by:

$$\lambda = C/f \tag{1}$$

wherein C is light speed equal to 300,000,000.

Antenna 14 is a spiral antenna transmitting dual frequencies of GSM and PCS/DCS type. Bandwidth of GSM is between 890 MHz and 960 MHz. Bandwidth of DCS is between 1710 MHz and 1880 MHz. Bandwidth of PCS is between 1850 MHz and 1990 MHz.

Figure 2:
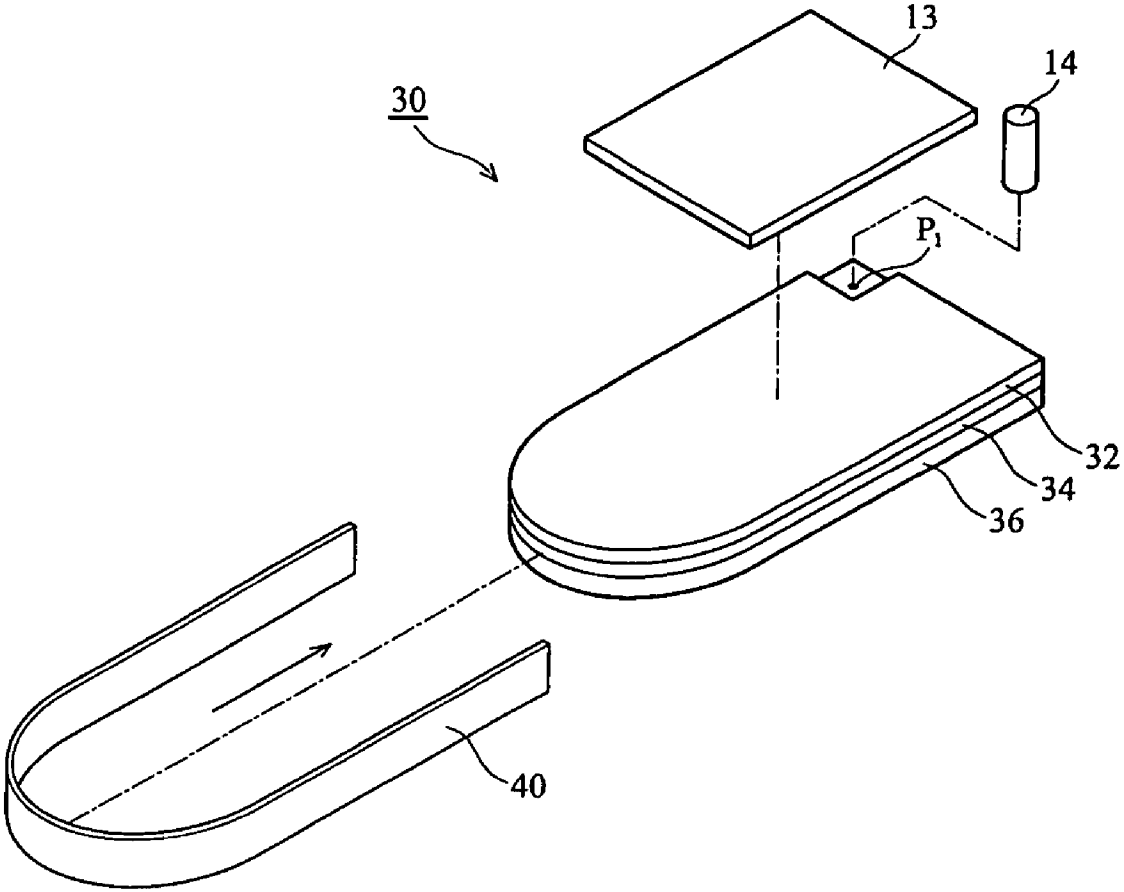
FIG. 2 is a schematic diagram of a cover of the mobile phone.

FIG. 2 is a schematic diagram of the second section 12 comprising printed circuit board (PCB) 30 and metal module 40. PCB 30 comprises a metal grounding face 32, an isolation layer 34, and a layout face 36. Isolation layer 34 is disposed between metal grounding face 32 and layout face 36. Material of isolation layer 34 is FR4.

Layout face 36 is opposite to metal grounding face 32. Antenna 14 is coupled to isolation layer 34 at node $P_1$. To avoid the metal interfering with the output signal form antenna 14, metal grounding face 32 covers a part of isolation layer 34, with antenna 14 coupled to another part of isolation layer 34.

Battery 13 is disposed on a surface of metal grounding face 32 providing power to PCB 30. Metal module 40 surrounds PCB 30 and is coupled to PCB at at least one node (not shown). Since metal module 40 is coupled to metal grounding face 32, when an ESD event occurs, discharge current generated thereby is quickly discharged to ground through metal grounding face 32.

Figure 3:
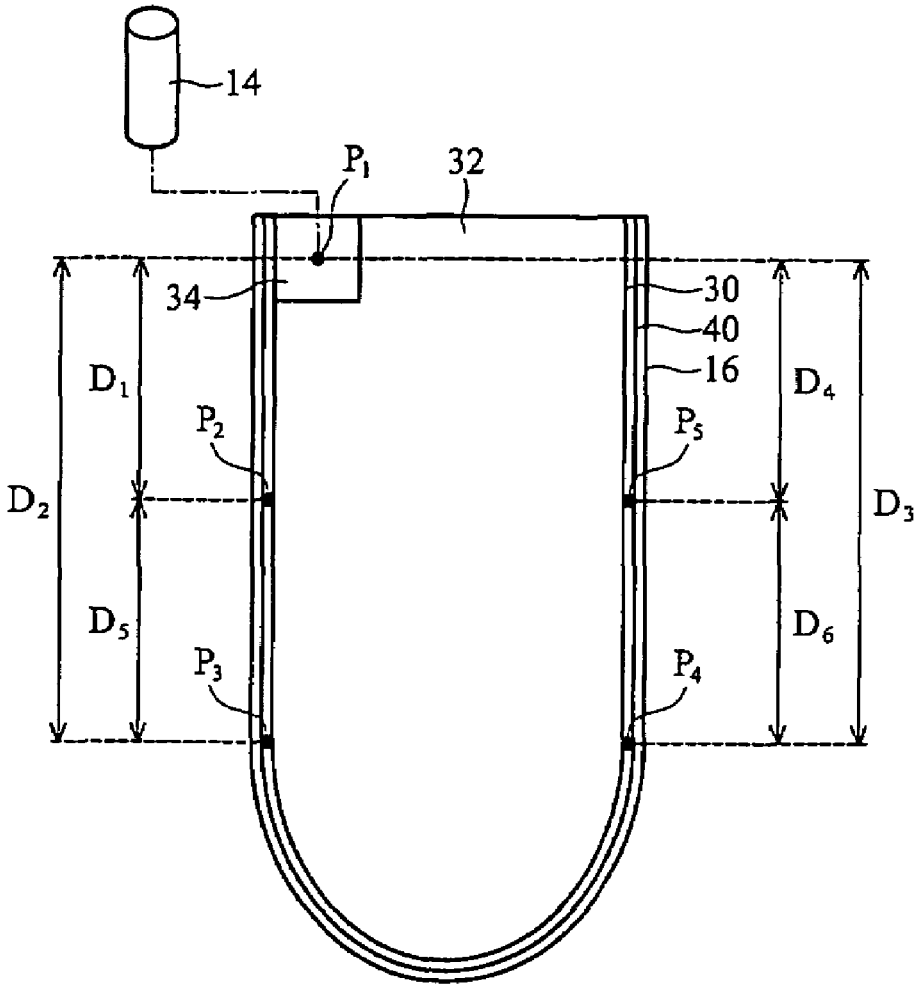
FIG. 3 is a connection schematic diagram of a metal module and PCB.

FIG. 3 is a connection schematic diagram of metal module and PCB. When antenna 14 is disposed in casing 16, metal module 40 is disposed in casing 16. As shown in FIG. 3, metal module 40 is disposed on an inner surface of casing 16 and coupled to metal grounding face 32 at nodes $P_2$~$P_5$. Metal module 40 can be disposed on an outer surface of casing 16, but is not limited thereto.

$D_1$ represents the distance between node $P_2$ and node $P_1$, $D_2$ represents the distance between node $P_3$ and node $P_1$, $D_3$ represents the distance between node $P_4$ and node $P_1$, and $D_4$ represents the distance between node $P_5$ and node $P_1$. Distances $D_1$~$D_4$ affect bandwidth and signal output of antenna 14, thus distances $D_1$~$D_4$ are determines by the wavelength λ. For example, distances $D_1$~$D_4$ may be determined by dividing the wavelength λ.

Since metal module 40 surrounds clam type mobile phone 10, as clam type mobile phone 10 is thrown, metal module 40 can protect clam type mobile phone 10. In addition, distances between node Pi and nodes $P_2$~$P_5$ are determined by the wavelength λ for avoiding metal module 40 interfering with the output signal from antenna 14. In this embodiment, metal module 40 is coupled to metal grounding face 32 at four nodes $P_2$~$P_5$.

The principle of a specific relation ship between distances $D_1$~$D_4$ and the wavelength λ shown in FIG. 3 is described as follows.

If the resonance frequency f is 1800 MHz, the wavelength λ is 0.1666 meters or 16.66 centimeters. In this embodiment, formula (2) can be obtained assuming the specific relation ship between distances $D_1$~$D_4$ and the wavelength λ. For example, distances $D_1$~$D_4$ may be determined by dividing the wavelength λ.

$$D_1 \sim D_4 = n/8\lambda \quad (2)$$

where n is defined by user. If n of distances $D_1$ and $D_4$ equals 1 and that of distances $D_2$ and $D_3$ equals 2, distances $D_1$ and $D_4$ are ⅛λ=2.08 centimeters and distances $D_2$ and $D_3$ are ⅜λ=4.16 centimeters.

The specific relation ship between distances $D_1$~$D_4$ and the wavelength λ can be set by any relation. In this embodiment, the specific relation is a dividing relation.

If a distance between a first node and a second node is not determined by the wavelength λ, output signal of antenna 14 is interfered with by metal module 40, wherein the first node is coupled to the metal module 40 and the metal grounding face 32 and the second node are coupled to antenna 14 and metal grounding face 32.

Figure 4A:
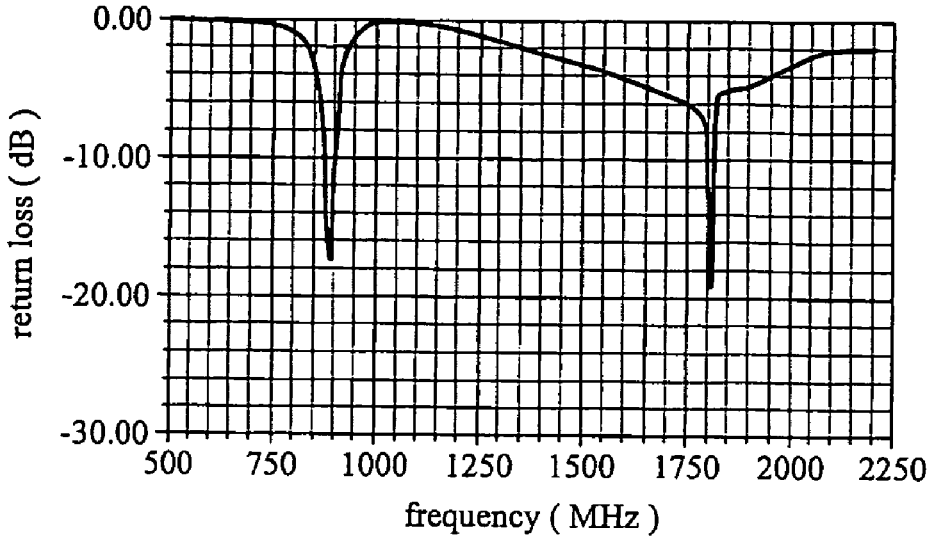
FIGS. 4*a*~4*c* are return loss diagrams for the antenna.
Figure 4B:
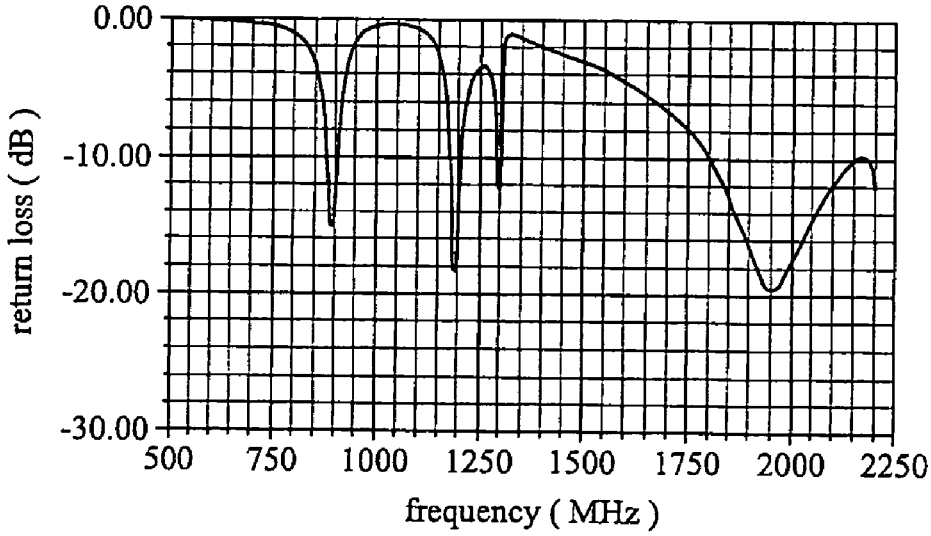
Figure 4C:
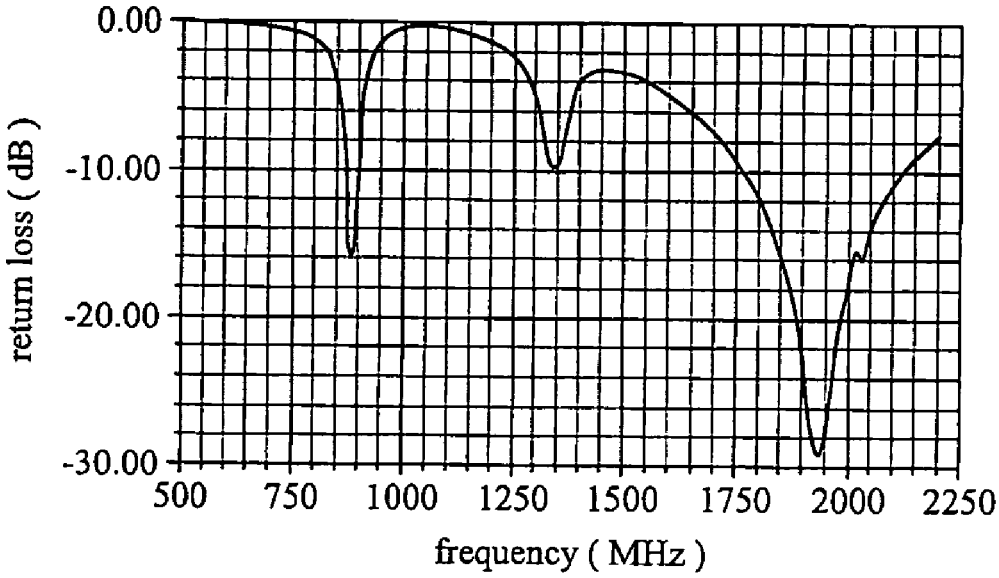

FIGS. 4*a*~4*c* are return loss diagrams for antenna 14. FIG. 4*a* is a return loss diagram for the antenna when a distance between the node coupled to metal module 40 and metal grounding face 32, and that coupled to antenna 14 and metal grounding face 32 is less than ⅛λ.

A minimum return loss of clam type mobile phone 10 is approximately −19.00 dB as the resonance frequency provided by antenna 14 is between 1710 MHz~1990 MHz.

FIG. 4*b* is a return loss diagram for the antenna when a distance between the node coupled to metal module 40 and metal grounding face 32, and that coupled to antenna 14 and metal grounding face 32 is less than ¼λ and exceeds ½λ.

A minimum return loss of clam type mobile phone 10 is approximately −20.00 dB when the resonance frequency provided by antenna 14 is between 1710 MHz~1990 MHz.

FIG. 4*c* is a return loss diagram for the antenna when the distance between the node coupled to metal module 40 and metal grounding face 32, and that coupled to antenna 14 and metal grounding face 32, is approximately ¼λ.

A minimum return loss of clam type mobile phone 10 is approximately −30.00 dB when the resonance frequency provided by antenna 14 is between 1710 MHz~1990 MHz.

As shown in FIGS. 4*a*~4*c*, a return loss for clam type mobile phone 10 is reduced when a specific relation ship, such as ¼', exist between the distance between the node coupled to metal module 40 and metal grounding face 32, and that coupled to antenna 14 and metal grounding face 32, and the wavelength λ.

Figure 5A:
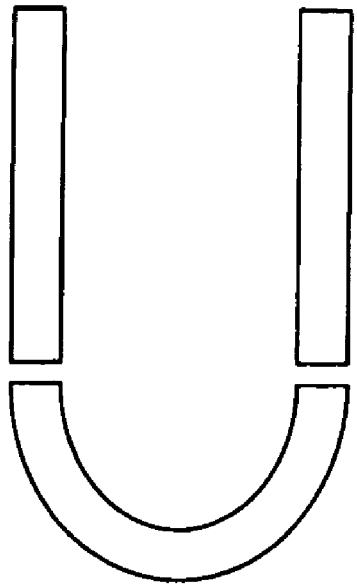
FIGS. 5*a*~5*e* are schematic diagrams of the metal module.
Figure 5B:
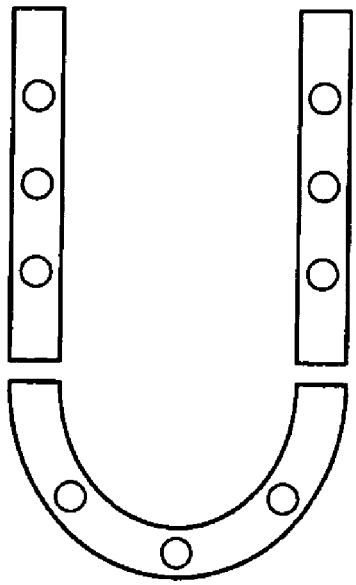
Figure 5C:
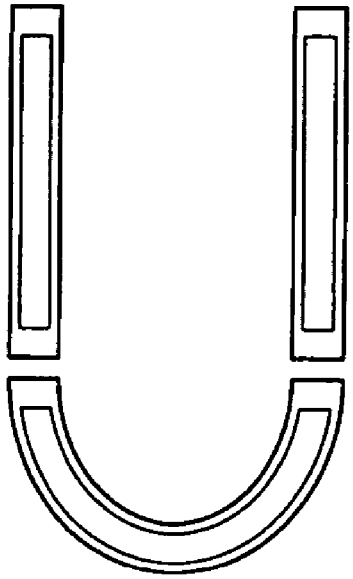
Figure 5D:
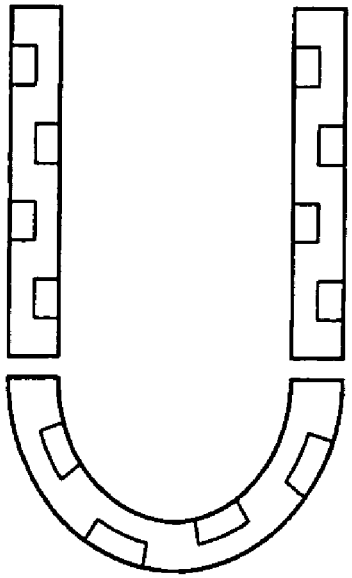
Figure 5E:
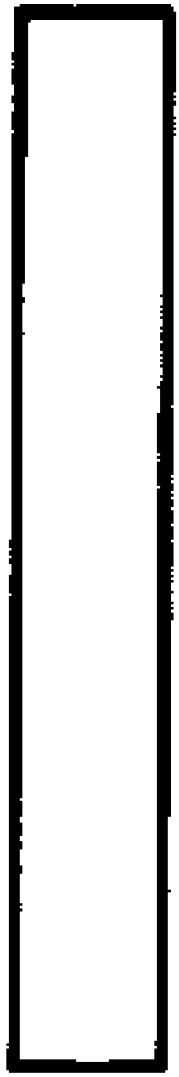

Metal module 40 is not limited and can be formed to any shape. In this embodiment, metal module 40 is U-shaped metal module. FIGS. 5*a*~5*e* are schematic diagrams of metal module 40. As shown in FIGS. 5*a*~5*d*, metal module 40 comprises three metal units. As shown in FIG. 5*b*, metal module 40 comprises circle notches. As shown in FIG. 5*c*, metal module 40 comprises oblong notches. As shown in FIG. 5*d*, metal module 40 is a zigzagged. As shown in FIG. 5*e*, metal module 40 is I-shaped.

Advantages of embodiments of the invention are summarized in the following.

First, the metal module can quickly discharge current to ground when ESD events occur in the mobile communication device.

Second, when a user mindlessly throws the mobile communication device, the metal module provides enhanced protection to the mobile communication device from impact.

Third, clam type mobile phone 10 has a minimum return loss when a distances between a first node, coupled to the metal module and a metal grounding face, and a second node, coupled to an antenna and the metal grounding face, is determined by a wavelength λ.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile communication device comprising:

an antenna providing an output signal comprising a first resonance frequency and a wavelength;

a printed circuit board comprising a metal grounding face and a layout face opposite to the metal grounding face and coupled to the antenna at a first node; and a metal module coupled to the metal grounding face at a second node;

wherein a distance between the first node and the second node is determined by the wavelength.

2. The mobile communication device as claimed in claim 1, wherein the distance is determined by dividing the wavelength.

3. The mobile communication device as claimed in claim 2, wherein the distance between the first node and second node equals approximately to a quarter of the wavelength.

4. The mobile communication device as claimed in claim 3, wherein the metal module is coupled to the metal grounding face at a third node, and a distance between the second node and the third node equals approximately a quarter of the wavelength.

5. The mobile communication device as claimed in claim 2, wherein the distance between the first node and the second node equals approximately an eighth part of the wavelength.

6. The mobile communication device as claimed in claim 1, wherein the metal module is U-shaped.

7. The mobile communication device as claimed in claim 6, wherein the metal module comprises circle notches.

8. The mobile communication device as claimed in claim 6, wherein the U-shaped metal module comprises oblong notches.

9. The mobile communication device as claimed in claim 6, wherein the U-shaped metal decoration is zigzagged.

10. The mobile communication device as claimed in claim 1, wherein the first resonance frequency is between 890 MHz and 960 MHz or between 1850 MHz and 1990 MHz.

11. The mobile communication device as claimed in claim 1, wherein the output signal further comprises a second resonance frequency.

12. The mobile communication device as claimed in claim 11, wherein the first resonance frequency is between 890 MHz and 960 MHz, and the second resonance frequency is between 1850 MHz and 1990 MHz.

13. The mobile communication device as claimed in claim 11, wherein the first resonance frequency is between 1850 MHz and 1990 MHz, and the second resonance frequency is between 890 MHz and 960 MHz.

14. The mobile communication device as claimed in claim 1, further comprising a casing, wherein the metal module is disposed on a surface of the casing.

15. The mobile communication device as claimed in claim 14, wherein the metal module is disposed on an outer surface of the casing.

16. The mobile communication device as claimed in claim 14, wherein the metal module is disposed on an inner surface of the casing.

17. The mobile communication device as claimed in claim 1, further comprising a battery disposed on a surface of the metal grounding face.

18. The mobile communication device as claimed in claim 1, wherein the antenna is a spiral antenna.

19. The mobile communication device as claimed in claim 1, wherein the printed circuit board further comprises an isolation layer disposed between the metal grounding face and the layout face.

20. The mobile communication device as claimed in claim 19, wherein the material of the isolation layer is FR4.

* * * * *